US006616583B1

(12) United States Patent
Stack

(10) Patent No.: US 6,616,583 B1
(45) Date of Patent: Sep. 9, 2003

(54) EXERCISE BOARD HAVING RESILIENT ROCKER-MOUNTING ENDS

(75) Inventor: Louis Stack, Calgary (CA)

(73) Assignee: Fitter International, Inc., Calgary (CA)

( * ) Notice: Subject to any disclaimer, the term of this patent is extended or adjusted under 35 U.S.C. 154(b) by 0 days.

(21) Appl. No.: 10/003,817

(22) Filed: Oct. 31, 2001

(51) Int. Cl.[7] ..... A63B 22/14; A63B 22/16
(52) U.S. Cl. ..... 482/146
(58) Field of Search ..... 482/146–147, 482/70–71, 75–77, 79, 80, 145, 148, 121, 122, 127

(56) References Cited

U.S. PATENT DOCUMENTS

| | | | | | |
|---|---|---|---|---|---|
| 337,146 | A | * | 3/1886 | Gluecksmann | 482/146 |
| 413,693 | A | * | 10/1889 | Walker | 482/146 |
| 822,448 | A | * | 6/1906 | Hanson | 482/146 |
| 3,119,626 | A | * | 1/1964 | Strader | 280/1.13 |
| 3,427,019 | A | * | 2/1969 | Brown | 482/146 |
| 3,929,329 | A | * | 12/1975 | Rivera | 272/57 D |
| 4,196,903 | A | * | 4/1980 | Illustrato | 272/114 |
| 4,509,743 | A | * | 4/1985 | Lie | 272/97 |
| 4,660,299 | A | * | 4/1987 | Omilusik | 36/7.8 |
| 4,966,364 | A | * | 10/1990 | Egenberger | 272/111 |
| 5,062,629 | A | * | 11/1991 | Vaughan | 272/97 |
| 5,080,382 | A | * | 1/1992 | Franz | 280/87.042 |
| 5,352,176 | A | * | 10/1994 | Huang | 482/146 |
| 5,391,134 | A | * | 2/1995 | Heatwole | 482/146 |
| 5,509,871 | A | * | 4/1996 | Giovanni | 482/51 |
| 5,795,277 | A | * | 8/1998 | Bruntmyer | 482/146 |
| 5,810,703 | A | | 9/1998 | Stack | |
| 6,413,197 | B2 | * | 7/2002 | McKechnie et al. | 482/146 |

* cited by examiner

*Primary Examiner*—Nicholas D. Lucchesi
*Assistant Examiner*—Lon Baker Amerson
(74) *Attorney, Agent, or Firm*—William Michael Hynes; Townsend and Townsend and Crew LLP

(57) ABSTRACT

An exercise board for accommodating the foot or feet of a balancing user during exercise movement has an elongated flat platform with opposite, typically upturned ends, similar to a skateboard. The board defines an upper facing side dimensioned to receive the foot or feet of the balancing user and a lower facing side. Resilient rocker-mounting ends are mounted to the lower facing side at either end of the elongated flat platform. Each resilient rocker-mounting end includes a rigid floor contacting rocker section and an elastic column. The floor contacting rocker section has a rounded floor-contacting surface. The elastic column is mounted to the elongated flat platform at the upper end, mounted to the floor contacting rocker at the lower end, and bendable both longitudinally and in torque responsive to shifting weight of a balancing user on the upper facing side of the elongate platform.

5 Claims, 2 Drawing Sheets

EXERCISE BOARD HAVING RESILIENT ROCKER-MOUNTING ENDS

This invention relates to an exercise/balance training board having the general shape of a skateboard platform equipped with resilient rocker-mounting ends. Use of the board includes alternate raising and lowering of one resilient rocker-mounting end against the elastic resistance of the supporting resilient rocker-mounting end.

BACKGROUND OF THE INVENTION

Skateboards are known. Typically such skateboards have an elongated flat platform with upturned ends. The platform has a width sufficient to accommodate the feet of the user. Under each end of the flat portions of the platform, there are located skate trucks, which are typically side-by-side mounted roller skate wheels.

Use of the skateboards is well known. Simply, the user places his weight for support by the board at a foot and propels with the other foot. Once in motion, the experienced user can balance with both feet placed on the board. Literally countless maneuvers and exercises can occur with respect to the moving—or even a stationary skateboard.

I have invented a device known as Exercise Board having Central Mounting with Multi-Level Adjustable Spacer set forth in Stack U.S. Pat. No. 5,810,703 issued Sep. 22, 1998. In this device, a wobble board is provided with the capability of varying the height between a sphere section on which the board is balanced and the board itself. In this device, the sphere section is of rigid construction. In use, the user "wobbles" the board on the rigidly attached spherical section. By varying the height of the board from the spherical section, the degree of difficulty can be varied with exercise being accordingly varied.

BRIEF SUMMARY OF THE INVENTION

An exercise board for accommodating the foot or feet of a balancing user during exercise movement has an elongated flat platform with opposite, typically upturned ends, similar to a skateboard. The board defines an upper facing side dimensioned to receive the foot or feet of the balancing user and a lower facing side. Resilient rocker-mounting ends are mounted to the lower facing side at either end of the elongated flat platform. Each resilient rocker-mounting end includes a rigid floor contacting rocker section and an elastic column. The floor contacting rocker section has a rounded floor-contacting surface. The elastic column is mounted to the elongated flat platform at the upper end, mounted to the floor contacting rocker at the lower end, and bendable both longitudinally and torsionally responsive to shifting weight of a balancing user on the upper facing side of the elongated platform. A balancing user can shift his weight to alternately load the resilient rocker-mounting ends. During the user's shifting movement, the loaded resilient rocker-mounting ends co-act with and against the balancing user's movement as their elastic columns bend and twist. Fun with challenging dynamic movement, balance training and exercise results.

DETAILED DESCRIPTION OF THE INVENTION

Figure 1:
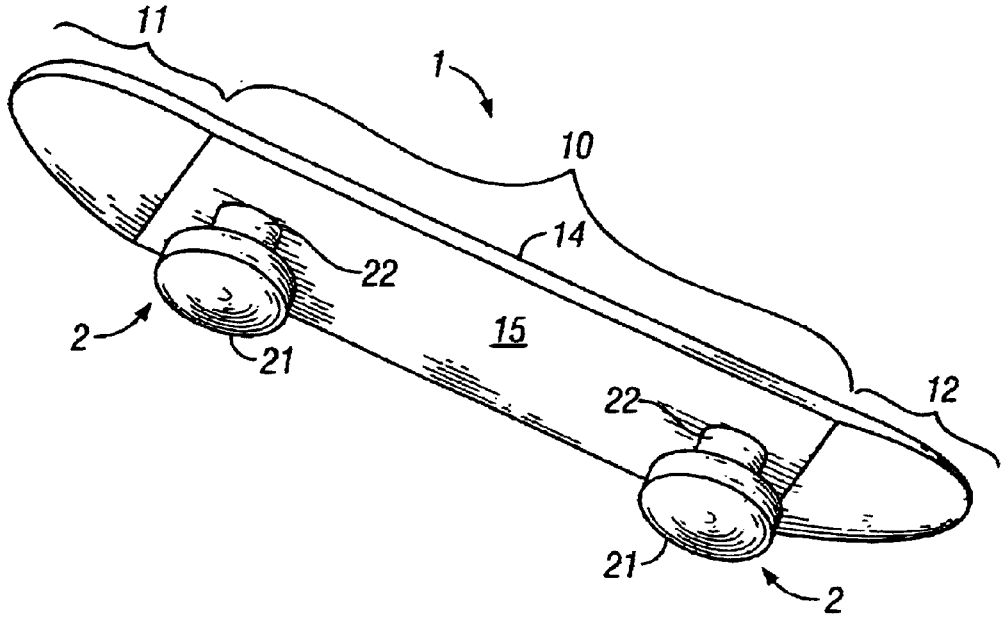
FIG. 1 is a perspective of the exercise board having resilient rocker-mounting ends.
Figure 2:
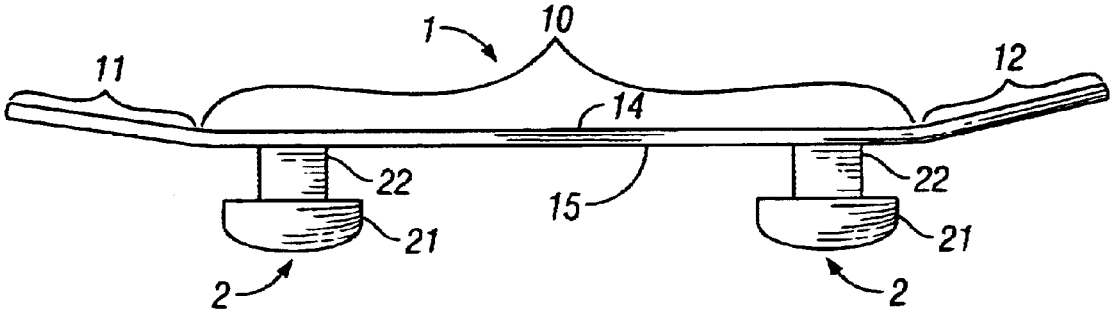
FIG. 2 is a side elevation view of the exercise board having resilient rocker-mounting ends; and, FIG. 3 is a perspective schematic of user, balancing on the board undertaking exercise.

Referring to FIG. 1, a perspective view of exercise board 1 of this disclosure is shown. It includes elongated flat platform 10 with respective upturned ends 11, 12. It includes upper facing side 14 onto which the user 3 at feet 31, 32 balances (See FIG. 3). Lower facing side 15 has resilient rocker mounted ends 2 attached thereto.

Resilient rocker mounted ends 2 include semi-rigid floor contacting rocker section 21 and elastic column 22.

Semi-rigid floor contacting rocker section 21 is of a hard or relatively hard elastic material. It is preferred that this material be of a non-slip nature with respect to the surface on which the semi-rigid floor contacting rocker section 21 rests. Thus when user 3 undertakes a movement, semi-rigid floor contacting rocker section 21 resists slipping. Further, the sticky or tacky surface remains stationary with respect to supporting surfaces so that elastic column 22 can both bend and undertake torsion. It will be understood that the point of contact of semi-rigid floor contacting rocker section 21 can vary and will only accept a certain level of force before it slides on the ground surface. On a skateboard this is known as a power slide. Here, it is shown in its preferred and rounded embodiment. Likewise, it can be made to have a relatively smaller or larger radius of curvature where it contacts the ground, hence making it easier or harder for the user to maneuver.

Semi-rigid floor contacting rocker section 21 can be constructed from substantially any material; we prefer plastic, hard urethane, and the like.

Elastic column 22 is preferably made from a natural or synthetic rubber or an elastic urethane in the preferred embodiment. The reader will understand that other materials will do as well. For example, this material could be composed of a steel spring. Elastic column 22 must be capable of bending responsive to the movement of user 3. Further, it is desired that this member be capable of being loaded in torsion and being compressed as exercise is undertaken.

Figure 3:
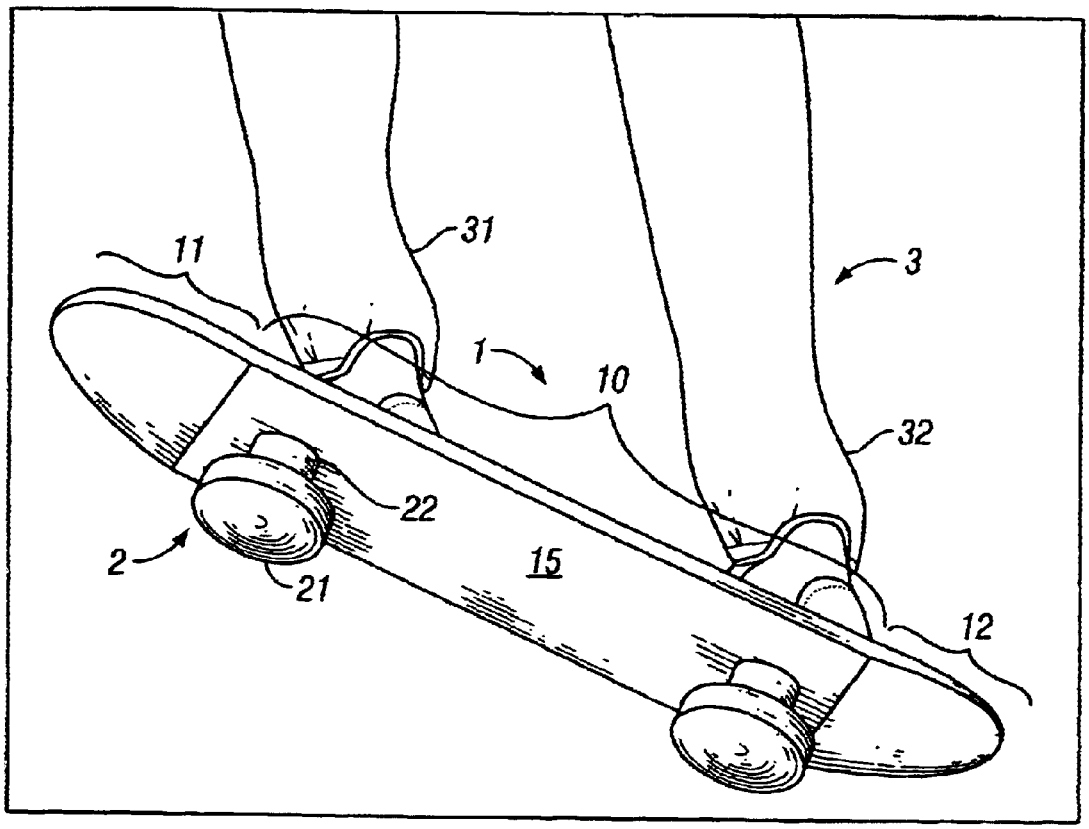

FIG. 3 illustrates user 3 having feet 31, 32 placed on the board. It can be seen that one board end is raised together with its semi-rigid floor contacting rocker section 21 while the remaining semi-rigid floor contacting rocker section 21 is in contact with the ground. It will be understood that semi-rigid floor contacting rocker section 21 in contact with the ground has its elastic column slightly compressed, loaded in torsion and bent longitudinally. It will be understood that user 3 is exercising with and against the elastic loading.

What is claimed is:

1. An exercise board for accommodating the foot or feet of a balancing user during exercise movement upon a floor comprising in combination:

an elongated flat platform having opposite ends and defining an upper facing side dimensioned to receive the foot or feet of the balancing user and a lower facing side;

two resilient rocker-mounting ends mounted to the lower facing side at either end of the elongated platform, each resilient rocker-mounting end separated from the other resilient rocker-mounting end;

each resilient rocker-mounting end including a floor contacting rocker section and an elastic column;

each of said floor contacting rocker sections having an independent lower floor contacting surface for adjustably removable contact with the floor;

each of said elastic columns mounted to said elongated flat platform at said upper end, and mounted to its lower floor contacting rocker at the lower end, and bendable responsive to shifting weight of a balancing user on the upper facing side of the elongated platform;

whereby a balancing user undergoing exercise can alternately lift one of said resilient rocker-mounting ends at its floor contacting surface from the floor while the other of said resilient rocker-mounting ends remains in contact with the floor with its elastic column loaded by the user's weight from the elongated flat platform to the floor.

2. The exercise board for accommodating the foot or feet of a balancing user during exercise movement according to claim 1 comprising in combination:

said elastic columns are bendable longitudinally and torsionally.

3. The exercise board for accommodating the foot or feet of a balancing user during exercise movement according to claim 1 comprising in combination:

said elongated flat platform has opposite upturned ends.

4. The exercise board for accommodating the foot or feet of a balancing user during exercise movement according to claim 1 comprising in combination:

said elastic column is an elastic rubber column.

5. A process of exercising on a board for accommodating the foot or feet of a balancing user during exercise movement comprising the steps of:

providing an elongated flat platform having opposite ends and defining an upper facing side dimensioned to receive the foot or feet of the balancing user and a lower facing side;

providing two resilient rocker-mounting ends mounted to the lower facing side at either end of the elongated platform, each resilient rocker-mounting end separated from the other resilient rocker-mounting end;

each resilient rocker-mounting end including a floor contacting rocker section and an elastic column;

each of said floor contacting rocker sections having an independent lower floor contacting surface for adjustably removable contact with the floor;

each of said elastic columns mounted to said elongated flat platform at said upper end, and mounted to its lower floor contacting rocker at the lower end, and bendable responsive to shifting weight of a balancing user on the upper facing side of the elongated platform;

shifting the balancing user's weight at the user's feet to alternately lift one of said resilient rocker-mounting ends at its floor contacting surface from the floor while the other of said resilient rocker-mounting ends remains in contact with the floor with its elastic column loaded by the user's weight from the elongated flat platform to the floor; and, moving the elongated flat platform with the user's feet against the elastic column loaded by the user's weight to for exercise.

* * * * *